United States Patent [19]

Nakamura et al.

[11] 4,032,302

[45] June 28, 1977

[54] CARBIDE ENRICHED HIGH SPEED TOOL STEEL

[75] Inventors: Hideki Nakamura, Yasugi; Kingo Kiyonaga, Yonago, both of Japan

[73] Assignee: Hitachi Metals, Ltd., Japan

[22] Filed: Dec. 16, 1975

[21] Appl. No.: 641,236

[30] Foreign Application Priority Data

Dec. 23, 1974 Japan ..... 49-146820

[52] U.S. Cl. ..... 75/240; 75/.5 BC; 75/122; 75/126 R; 75/126 A; 75/126 C; 75/126 D; 75/126 E; 75/126 H; 75/126 J; 75/134 F

[51] Int. Cl.[2] ..... C22C 33/02

[58] Field of Search ..... 148/37; 75/126 A, 126 C, 75/126 D, 126 E, 126 H, 126 J, 126 R, 128 B, 128 W, 128 V, 128 R, .5 BC, ,5 AC, 134 F, 122; 29/182.7, 182.8

[56] References Cited

UNITED STATES PATENTS

| | | | |
|---|---|---|---|
| 1,982,421 | 11/1934 | Emmons | 75/128 V |
| 2,793,113 | 5/1957 | Rait et al. | 75/128 G |
| 3,012,879 | 12/1961 | Schempp | 75/126 E |
| 3,556,780 | 1/1971 | Holtz, Jr. | 75/.5 BC |
| 3,704,115 | 11/1972 | Wastenson et al. | 75/.5 BC |
| 3,850,621 | 11/1974 | Haberling | 75/126 C |

FOREIGN PATENTS OR APPLICATIONS

| | | | |
|---|---|---|---|
| 657,144 | 12/1964 | Belgium | 75/126 C |
| 1,108,497 | 9/1954 | France | 75/126 C |
| 80,323 | 3/1971 | Germany | 75/126 C |
| 45-40777 | 6/1967 | Japan | 75/126 C |
| 1,297,748 | 11/1972 | United Kingdom | 75/126 C |

*Primary Examiner*—Arthur J. Steiner
*Attorney, Agent, or Firm*—Craig & Antonelli

[57] ABSTRACT

A carbide enriched high speed tool steel having good toughness, excellent wear resistance and excellent cutting endurance which by weight consists essentially of 0.62 – 3.95 % of carbon, totally 24 – 50 % of tungsten and twice amount of molybdenum, 3.0 – 5.0 % of chromium, 1.0 – 10.0 % of vanadium, 5 – 15 % of cobalt and the balance consisting essentially of iron and impurities and which is produced by powder metallurgical process.

14 Claims, 4 Drawing Figures x 1000 x 1000

CARBIDE ENRICHED HIGH SPEED TOOL STEEL

BACKGROUND OF THE INVENTION

1. Field of the Invention

The present invention relates to a high speed tool steel which in its quenched state has much higher carbides content than the conventional high speed tool steel, has excellent wear resistance, and toughness which results from uniform and fine dispersion of said carbides in matrix and has a high cutting endurance.

2. Description of the Prior Art

A high speed tool steel generally contains a large amount of elements which form carbides such as tungsten, molybdenum, vanadium, chromium, etc., most of which form carbides and are not completely dissolved in the matrix even by quenching and remain in the steel to impart abrasion resistance.

For example, the high speed tool steels which are generally used at present contain about 15 – 30% (by weight) of carbides in their annealed state, but in their quenched state a part of these carbides are dissolved in the matrix and about 5 – 16% of the carbides remain and greatly contribute to improvement in wear resistance. The wear resistance of high speed tool steels which have a sufficiently hardened matrix depends on amount, kind, size, distribution of said remaining carbides, among which kind and amount of the remaining carbides have the greatest effect on the abrasion resistance.

Kind and amount of the remaining carbides are determined by the amounts of tungsten, molybdenum, vanadium and carbon added to the steels. With increase in the amounts of tungsten, molybdenum and carbon added, amount of $M_6C$ type carbides containing tungsten and molybdenum increases and with increase in the amounts of vanadium and carbon, amount of MC type carbides containing a large amount of vanadium increases. With increase in the amount of carbides remaining in the steel, the wear resistance increases. In this case, increase in the amount of MC type carbides which are harder than $M_6C$ type carbides is more effective for improvement in the wear resistance and in general, amount of vanadium and the corresponding amount of carbon are increased for improving wear resistance of a high speed tool steel. However, in the conventional melting process, increase in the amounts of vanadium and carbon results in coarsening of the MC type carbides to cause reduction in hot workability and toughness and to make grinding working impossible. For these reasons, such steels cannot be made into practical tools and amount of vanadium added has been limited to less than about 6% except some particular cases. With reference to increase in the amounts of tungsten and molybdenum, when tungsten equivalent exceeds 20%, ferrite remains to cause reduction in hardness and according to the conventional melting process, coarse dendrite network of $M_6C$ type carbides are precipitated in cast state to markedly deteriorate hot workability and toughness. Therefore, tungsten equivalent for practical steels is limited to less than 20%. The term "tungsten equivalent" means the sum of amount of tungsten in % by weight and twice the amount of molybdenum in % by weight. As is easily understandable for one skilled in the art, this is the value of amount of molybdenum added to a high speed tool steel which is indicated by the amount of tungsten. However there are some examples which contain more carbides former elements than conventional high speed tool steels for the purpose of improving wear resistance. For example, Japanese Patent Publication No. 21534/69 discloses steels of SKH 9 class in which the vanadium content is increased to 12.2 % and those of SKH 55 class in which the vanadium content is increased to 10%.

However, all of these known examples aim at improving the wear resistance by increasing the vanadium content in the steel to increase the amount of crystal of MC carbides and in these known examples the tungsten equivalent in the steel is not increased to at least 24% as in the present steel.

Thus, in the conventional melting process, there are limitations in the amounts of tungsten, molybdenum and vanadium and amount of the remaining carbides at quenching is limited to about less than 15%, which is the definite reason for the fact that such steels are inferior to carbide tools in wear resistance.

SUMMARY OF THE INVENTION

It is an object of the present invention to provide a novel high speed tool steel which in its quenched state contains at least 24% of the remaining carbides homogeneously and finely dispersed in matrix and which has high wear resistance and toughness and excellent cutting endurance.

The inventors have made researches on influence of kind and amount of carbides and components of matrix on carbide enriching effect. As the result, it has been found that combination of wear resistance, toughness and heat resistance optimum as cutting tool materials, especially excellent wear resistance at high speed cutting, excellent toughness which counterbalances high temper strength and extremely improved cutting endurance can be obtained by increasing vanadium content to increase the amount of MC type carbides and simultaneously by increasing the tungsten equivalent to enrich the amount of $M_6C$ type carbides.

The above mentioned object of the present invention can be attained by producing, in accordance with powder metallurgical process, a steel which by weight consists essentially of 0.62 – 3.95% of carbon, a tungsten equivalent of 24 – 50%, 3 – 5% of chromium, 1.0 – 10.0% of vanadium, 5 – 15% of cobalt with the balance essentially iron and impurities.

DETAILED DESCRIPTION OF THE INVENTION

Figure 1:
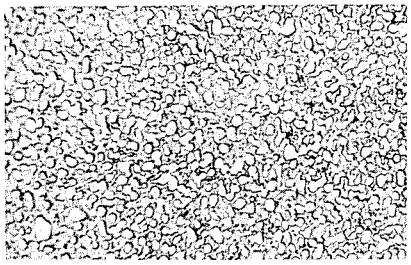
FIG. 1 is a microphotograph which shows microstructure of the steel of the present invention.

The present invention relates to a carbide enriched high speed tool steel which consists essentially of, by weight, 0.62 – 3.95% of carbon, 24 – 50% of tungsten plus twice amount of molybdenum, 3.0 – 5.0% of chromium, 1.0 – 10.0% of vanadium, 5 – 15% of cobalt and the balance essentially iron and impurities and which is produced by powder metallurgical process. Also, the steels of the present invention are able to contain small amount of titanium and nitrogen for the purpose of getting higher hardness as compared with the conventional high speed tool steel. The term "powder metallurgical process" herein used means a process which was already known, e.g., in Japanese Patent Publication No. 21534/69 and which comprises powdering a melt of a known high speed tool steel by atomizing method and then compacting the powders by sintering, hot extrusion, hot forging, and hot isostatic compaction method to obtain a dense body of a high speed tool steel.

More preferred alloy compositions of the present steel are as follows:

In the case of the tungsten equivalent being 24 – 30%, the combination of 0.67 – 2.05% of carbon, 3.0 – 5.0% of chromium and 1.0 – 4.0% of vanadium is desired and for attaining further improvement in wear resistance by increasing the amount of MC type carbides, the preferred combination is 1.27 – 3.55% of carbon, 3.0 – 5.0% of chromium and 4.0 – 10.0% of vanadium.

In the case of the tungsten equivalent being 30 – 50%, it is preferred to employ the combination of 0.87 – 2.68% of carbon, 3.0 – 5.0% of chromium and 1.0 – 7.0% of vanadium and for further improving wear resistance by increasing the amount of MC type carbides, it is preferred to employ the combination of 1.47 – 3.88% of carbon, 3.0 – 5.0% of chromium and 4.0 – 10.0% of vanadium.

The optimum alloy composition of the present steel, taking mechanical properties, wear resistance, cutting tool life, etc. into consideration, is about 1.3% of carbon, about 24.5% of tungsten equivalent, about 3.6% of chromium, about 3.5% of vanadium, about 8.4% of cobalt and the balance essentially iron and impurities.

Excellent properties of the present steel will be explained below by means of examples. Table 1 shows the chemical components of the present steels, the comparative steels and the conventional steels.

Table 1

| | Alloy No. | C | Cr | Mo | W | V | Co | Ti | N | Fe | W + 2Mo |
|---|---|---|---|---|---|---|---|---|---|---|---|
| The present steels | 1 | 1.27 | 4.0 | 10.22 | 11.32 | 1.98 | 12.0 | — | 0.034 | Bal | 31.76 |
| | 2 | 1.34 | 3.84 | 10.40 | 15.78 | 1.99 | 12.2 | — | 0.037 | " | 36.58 |
| | 3 | 1.38 | 3.67 | 10.34 | 20.72 | 1.97 | 12.1 | — | 0.036 | " | 41.40 |
| | 4 | 1.42 | 3.85 | 10.20 | 25.03 | 1.98 | 12.1 | — | 0.035 | " | 45.43 |
| | 5 | 1.45 | 3.77 | 10.0 | 29.04 | 1.97 | 12.1 | — | 0.029 | " | 39.04 |
| | 6 | 1.67 | 3.80 | 10.07 | 11.78 | 4.40 | 12.2 | — | 0.030 | " | 31.92 |
| | 7 | 2.50 | 3.79 | 10.06 | 11.88 | 8.50 | 12.1 | — | 0.028 | " | 32.00 |
| | 8 | 1.63 | 3.75 | 10.04 | 11.50 | 1.96 | 12.0 | — | 0.024 | " | 31.58 |
| | 9 | 1.11 | 3.76 | 10.05 | 11.60 | 1.94 | 6.0 | — | 0.030 | " | 31.70 |
| | 10 | 1.24 | 3.88 | 5.0 | 20.44 | 1.96 | 8.0 | — | 0.031 | " | 30.44 |
| | 11 | 3.76 | 3.94 | 9.90 | 29.88 | 9.6 | 8.0 | — | 0.025 | " | 49.68 |
| | 12 | 1.26 | 3.88 | 10.05 | 12.01 | 1.97 | 12.1 | 0.054 | 0.055 | " | 32.11 |
| | 13 | 1.34 | 3.59 | 7.50 | 8.0 | 3.47 | 8.40 | — | 0.035 | " | 24.50 |
| Comparative steels | 21 | 3.02 | 4.23 | 5.53 | 6.44 | 9.70 | 12.0 | — | 0.024 | " | 17.50 |
| | 22 | 2.51 | 3.90 | 4.97 | 5.89 | 10.03 | 7.64 | — | 0.030 | " | 15.83 |
| | 23 | 3.62 | 4.26 | 5.18 | 5.07 | 14.56 | 8.52 | — | 0.029 | " | 15.43 |
| | 24 | 3.64 | 3.85 | 4.0 | 0.98 | 13.14 | 7.64 | — | 0.030 | " | 8.98 |
| | 25 | 2.56 | 3.76 | 9.0 | 2.1 | 10.0 | 12.10 | — | 0.027 | " | 20.10 |
| Conventional steels | 31 | 1.52 | 3.98 | 0.5 | 12.1 | 5.0 | 5.0 | — | 0.036 | " | 13.1 |
| | 32 | 1.25 | 3.99 | 3.3 | 10.0 | 3.50 | 9.60 | — | 0.027 | " | 16.6 |

Figure 2:
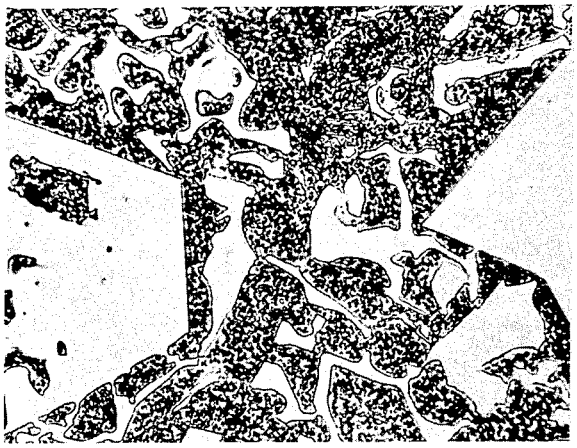
FIG. 2 is a microphotograph which shows microstructure of a conventional steel produced by melting process.

In the above Table, alloys No. 31 and 32 as the conventional steels are SKH 10 and SKH 57 in JIS (Japanese Industrial Standard), respectively, Samples of the present steels and the conventional steels were prepared by the method of powder metallurgy which comprises atomizing the melts of these alloys by jet stream of nitrogen gas, then sieving the powders to obtain those of +32 to −325 meshes, charging thus obtained alloy powders in a soft steel capsule of 68 mm $\phi$, degassing and sealing the capsule, compacting the powders by hot extrusion process at an extrusion ratio of 5, and then further hot forging. Thus obtained samples were completely dense bodies and had a density of at least 99.9% and an oxygen content of not more than 100 ppm. The samples after hot extruded were maintained at 900° C – 1000° C for 3 hours, then were slowly cooled to 650° C at a cooling rate of 15° C/Hr and then were air cooled to room temperature. The comparative samples were prepared by ingot-making, in an electric furnace in accordance with the conventional method, the SKH 10 and SKH 57 obtained by melting process, annealing the ingot, hot working it at 1130° C at a forging ratio of 10 and then again annealing it. As a typical example of microstructure after annealing treatment, the microstructure at preparation of alloy is shown in FIG. 1. The alloy No. 1 at annealed state contained 42% by weight of carbides which was determined by measuring amount of extraction residue of carbides by electrolytic extraction. In spite of such higher carbide content, particle size of the carbides was very fine, the distribution of the particle size was uniform and there were utterly no coarse carbides of more than 5 $\mu$. For comparison, annealed microstructure of the same alloy prepared by melting process is shown in FIG. 2, from which it will be recognized that microstructure of the present steel was extremely excellent. The annealed samples shown in Table 1 were further subjected to quenching and tempering treatments and these samples were tested on mechanical properties, wear resistance, cutting endurance, etc. and suitability of the present steel as a cutting steel was evaluated. At the same time, amount of undissolved carbides in the samples after quenching was also measured by electrolytic extraction method to detailedly examine enriching effect of the carbides.

Table 2 shows hardness and deflective strength of the present steels, comparative steels and conventional steels at tempering at 560° C and amount of carbides in these steels at quenching.

Table 2

| Alloy No. | Hardness (HRC) | Deflective strength (kg/mm²) | Amount of carbides (% by weight) |
|---|---|---|---|
| 1 | 68.5 | 360 | 32 |
| 2 | 69.5 | 335 | 37 |

Table 2-continued

| | | Alloy No. | Hardness (HRC) | Deflective strength (kg/mm²) | Amount of carbides (% by weight) |
|---|---|---|---|---|---|
| The present steels | | 3 | 70.3 | 290 | 43 |
| | | 4 | 70.9 | 260 | 48 |
| | | 5 | 71.6 | 200 | 58 |
| | | 6 | 68.3 | 320 | 32 |
| | | 7 | 68.6 | 280 | 39 |
| | | 8 | 69.7 | 260 | 31 |
| | | 9 | 67.2 | 390 | 60 |
| | | 10 | 68.1 | 340 | 36 |
| | | 11 | 72.4 | 170 | 64 |
| | | 12 | 69.0 | 355 | 32 |
| | | 13 | 68.7 | 440 | 24.3 |
| Comparative steels | | 21 | 71.1 | 180 | 20 |
| | | 22 | 67.5 | 280 | 23 |
| | | 23 | 67.0 | 200 | 26 |
| | | 24 | 67.0 | 190 | 18 |
| | | 25 | 67.5 | 250 | 20 |
| Conventional steels | Powder method | 31 | 66.5 | 380 | 14 |
| | | 32 | 67.0 | 420 | 12 |
| | Melting method | 31 | 66.6 | 280 | 14 |
| | | 32 | 67.1 | 300 | 12 |

The quenching temperature was a temperature lower by 40° C than a temperature at which the carbides begin to melt. Furthermore, with reference to the conventional steels, comparisons were also made on SKH 10 and SKH 57 obtained by powder metallurgical process and melting process.

It is clear that the present steels, in spite of their higher carbide content than the comparative and conventional steels, had a higher deflective strength and especially higher deflective strength at higher temper hardness.

Figure 3:
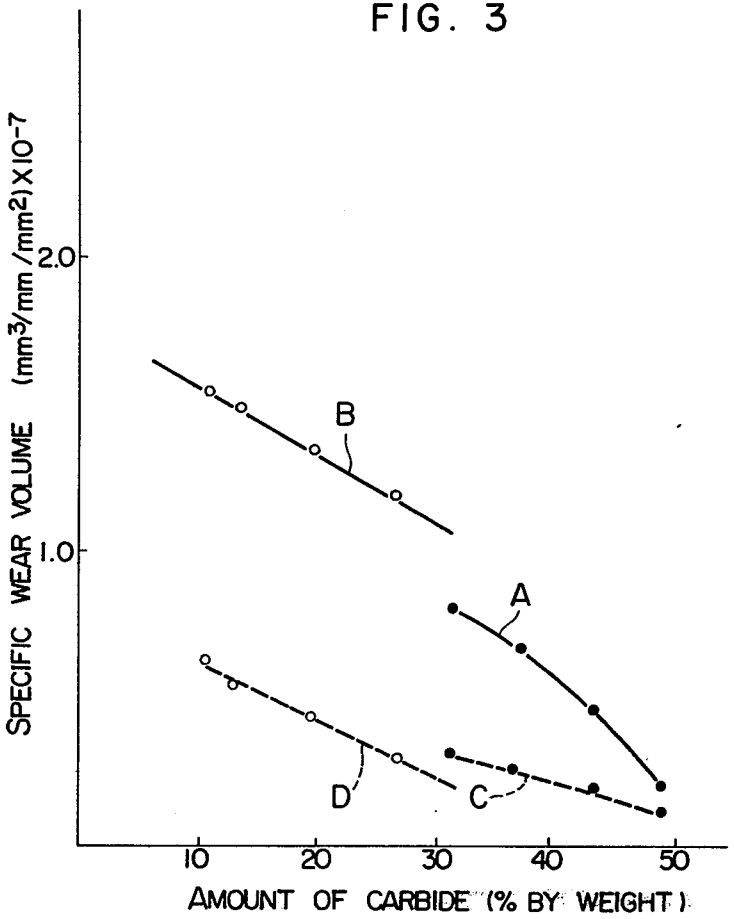
FIG. 3 is a graph which shows comparison of wear resistances of the steel of the present steel, comparative steels and conventional steels.

For example, although alloys No. 1, 2, 6, 8, 9 and 10 contained at least 24% by weight of carbides at quenched state, they had excellent mechanical property of higher than 300 kg/mm² in deflective strength at higher hardness level of at least 67 in HRC. That is, in spite of these alloys having high hardness, they had much higher deflective strength than SKH 10 and SKH 57 obtained by melting process. Furthermore, it is clear that in spite of higher carbide content the present steels in which $M_6C$ type carbides were enriched by increasing the tungsten equivalent had higher deflective strength than the comparative steels 21, 22, 23, 24 and 25 in which MC type carbides were enriched by merely increasing the amount of vanadium and it is also clear that the present steels had excellent toughness. FIG. 3 shows comparison of wear resistance of the present $M_6C$ type carbides enriched steel and the MC type carbides enriched steel at friction velocities of 3.5 m/sec and 1.14 m/sec. Curves A and B indicate the case of the friction velocity being 3.5 m/sec and curves C and D indicate the case of the friction velocity being 1.14 m/sec. The curves A and C show the test results on the alloys No. 1, 2, 3 and 4 of the present steels, the specific wear volume of which decreased in this order as shown by the points on the curves. The curves B and D show the test results on the alloys No. 32, 31, 21 and 22, the specific abrasion volume of which decreased in this order as shown by the points on the curves.

Measurement of the specific wear volume was carried out by Ogoshi's rapid abrasion testing method using SCM 21 ($H_B$ 280) as a friction ring, a load of 6.8 kg and a friction distance of 400 m.

The present steels were smaller in the specific wear volume at both of said two friction velocities than the comparative and conventional steels and the specific wear volume of the present steels markedly decreased especially at the high friction velocity of 3.5 m/sec. Thus, it is clear that especially the enrichment of $M_6C$ type carbides much improves the wear resistance at a high friction velocity range.

Figure 4:
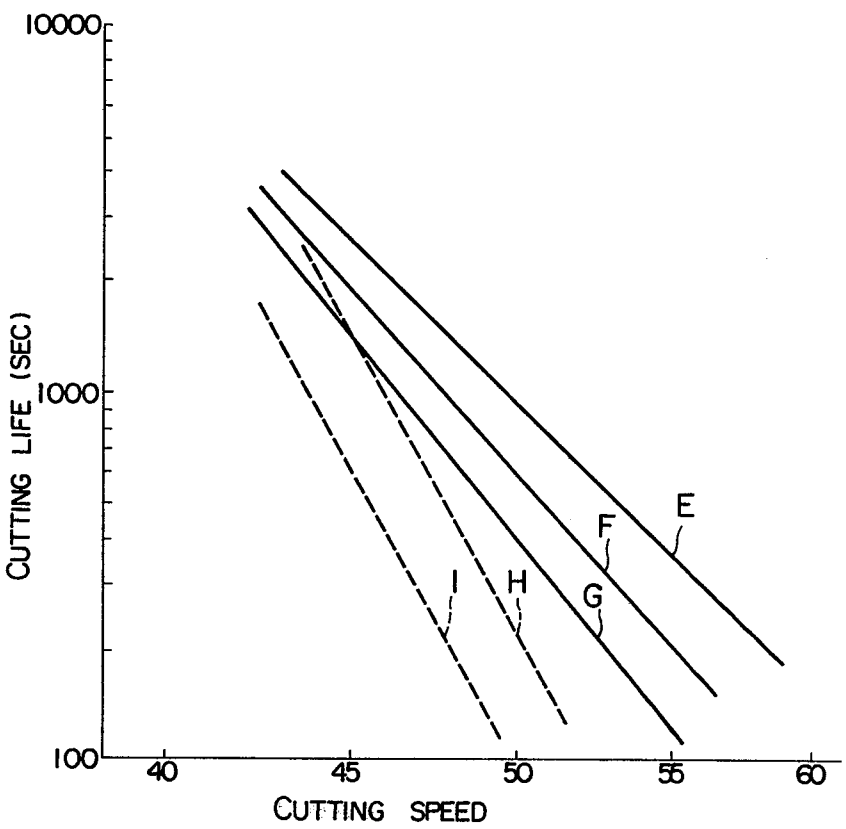
FIG. 4 is a graph which shows comparison of tool life.

FIG. 4 is a graph which shows the results of comparison of cutting tool life by the continuous cutting test with S45C ($H_B$ 180) and curves E, F, G, H and I indicate alloys No. 4, 6, 1, 21 and 32, respectively. The testing conditions are as follows:

Feed — 0.3 mm/rev
Depth of cut — 1 mm
Cutting speed — 45, 50, 55 m/min.

Comparison was made on endurance time required for expiration of the life of the cutting tools. It is clear that the present steels had long cutting tool life and were markedly improved especially in cutting tool life at high speed cutting. From the above results, it is clear that the present steels had excellent mechanical properties, wear resistance and cutting tool life. It can be easily recognized from the excellent wear resistance at a high speed friction as shown in FIG. 3 that the tool life at a high speed cutting can be markedly improved in the present steel which is $M_6C$ type carbide enriched steel. Furthermore, a slight amount of elements such as Ti, N, etc. may be added alone or in combination to the present steel. The alloy No. 12 corresponds to the alloy No. 1 to which a slight amount of Ti and N were added. Addition of these elements somewhat increased the hardness without decreasing the toughness.

Reasons for limitation of the content of the components in the present steel are explained below.

Lower limit of tungsten equivalent should be 24% and upper limit of the tungsten equivalent should be 50%. When the tungsten equivalent is less than 24%, amount of undissolved $M_6C$ type carbides is small and enrichment of $M_6C$ type carbides which is one of the characteristics of the present invention becomes low to lose the characteristic of wear resistance at high speed friction. Thus, a tungsten equivalent of at least 24% is required. When the tungsten equivalent exceeds 50%, content of carbides becomes excessively high to damage the toughness and in addition the alloy becomes expensive. Thus, the tungsten equivalent of more than 50% is not preferred. Furthermore, it is possible to adjust the amount of the $M_6C$ type carbides which influence the wear resistance at a high speed friction by employing a tungsten equivalent of 24 – 30% or 30 – 50% which balances with the amounts of carbon, chromium and vanadium. Regarding the proportion of tungsten and molybdenum, since molybdenum has nearly the same effect as tungsten in a high speed steel, the whole amount of tungsten may be substituted with molybdenum, but since tungsten is more preferred than molybdenum for softening resistance at high temperature of the matrix, it is not preferred to use molybdenum excessively in the case of the softening resistance also being important. Next, suitably, lower limit of vanadium is 1% and upper limit of vanadium is 10%. When content of vanadium is less than 1%, wear resistance at lower friction is reduced and this is not preferred. When content of vanadium exceeds 10 %, coarse MC type carbides are precipitated even if rapidly cooled atomized powders are used and refining effect of the carbides is lost. Thus, the range of vanadium content should be specified between 1 and 10%. Furthermore, if a proper amount of MC type carbides are formed by balancing the content of vanadium with the contents of carbon, chromium, tungsten and molybdenum, vanadium may be contained in an amount of 1.0 – 4.0% or when wear resistance is further demanded, in an amount of 4.0 – 10.0%. The optimum content of vanadium is about 3.5%. When content of chromium is less than 3%, hardenability is reduced and moreover amounts of dissolved tungsten and molybdenum required for sufficiently hardening the matrix become smaller. Therefore, at least 3% of chromium is necessary. When content of chromium exceeds 5%, toughness is lowered. Therefore, range of the chromium content is 3–5%. The optimum content of chromium is about 3.6%. At least 5% of cobalt is necessary for increasing amounts of tungsten and molybdenum dissolved in the matrix and increasing softening resistance. When content of cobalt is less than 5%, the high temper hardness which is one of the characteristics of the present steel cannot be obtained and when it exceeds 15%, increase in the temper hardness is small and toughness is decreased. Therefore, range of the cobalt content should be specified as 5 – 15%. When decrease in toughness is especially to be avoided, the cobalt content is desirably 5 – 13%. The optimum cobalt content is about 8.4%.

Carbon is necessary in order that it combines with tungsten, molybdenum, chromium, vanadium, etc. to produce carbides and moreover it dissolves in the matrix to provide a high temper hardness. Generally, suitable carbon content is given in accordance with the following formula:

$$C\ (\%) = 0.06\ Cr + 0.033\ W + 0.0630Mo + 0.2\ V$$

In the case of the present steel, also the suitable carbon content is given by said formula. However, since in the case of very high carbide content as in the present steel, dispersion hardening effect of the carbides appears, hardness of the matrix may be reduced. It has become clear that somewhat smaller carbon content than that given by said formula rather provides better toughness. For example, in the case of alloy No. 8 in Table 1, carbon was added in the amount given by said formula and in the case of alloy No. 1, carbon was added in the amount smaller by about 0.4% than that of the alloy No. 8. When these alloys are compared, the alloy No. 1 is much superior to the alloy No. 8 in toughness although hardness of the former somewhat decreases. Therefore, proper carbon content may be optionally varied depending on kind and object of tool.

Therefore, in the case of the present steel, range of proper carbon content is given by the following formula:

$$C = (0.06\ Cr) + (0.033\ W) + (0.063\ Mo) + (0.2\ V_{-0.5}^{+})$$

When upper limit and lower limit of chromium, tungsten, molybdenum and vanadium contents are put in this formula, the carbon content is 3.95% in maximum and 0.62% in minimum. This range is that of carbon content in the present steel. Furthermore, balancing with the above mentioned tungsten equivalent and amounts of chromium and vanadium, when the tungsten equivalent is 24–30% per 3.0–5.0% of chromium, carbon content may be 0.67–2.05% per 1.0–4.0% of vanadium and 1.27–3.55% per 4.0–10.0% of vanadium. On the other hand, when the tungsten equivalent is 30–50%, carbon content may be 0.87–2.68% per 1.0–4.0% of vanadium and 1.47–3.88% per 4.0–10.0% of vanadium. The optimum carbon content is about 1.3%.

In order to increase hardness by adding a slight amount of Ti and N without damaging the toughness, 0.03 – 0.15% of Ti and 0.01 – 0.07% of N may be added alone or in combination.

As mentioned hereinbefore, the high speed tool steel of the present invention produced by powder metallurgical process contains at least 24% of $M_6C$ type carbides and is high in toughness and especially excellent in wear resistance at high speed cutting and thus this is the most suitable as cutting tool materials.

The percentages indicating the contents herein are all by weight.

What is claimed is:

1. A high speed tool steel enriched with at least 24% of carbides in the quenched state, which consists essentially of, by weight, 0.62 – 3.95% of carbon, 24 – 50% of a tungsten equivalent that is the sum of the content of tungsten and twice the content of molybdenum, 3.0 – 5.0% of chromium, 1.0 – 10.0% of vanadium, 5 – 15% of cobalt and the balance consisting essentially of iron and impurities and which is produced by a powder metallurgical process that includes preparing an alloy powder and compacting of the powder, said carbides including the MC and $M_6C$ type carbides.

2. A high speed tool steel according to claim 1, wherein the carbon content is 0.67 – 2.05%, the sum of the tungsten content and twice the molybdenum content is 24 – 30%, the vanadium content is 1.0 – 4.0% and the cobalt content is 5 – 13%.

3. A high speed tool steel according to claim 1, wherein the carbon content is 1.27 – 3.55%, the sum of the tungsten content and twice the molybdenum content is 24 – 30% and the vanadium content is 4.0 – 10.0% and the cobalt content is 5 – 13%.

4. A high speed tool steel according to claim 1, wherein the carbon content is 0.87 – 2.68%, the sum of the tungsten content and twice the molybdenum content is 30 – 50%, the vanadium content is 1.0 – 4.0% and the cobalt content is 5 – 13%.

5. A high speed tool steel according to claim 1, wherein the carbon content is 1.47 – 3.88%, the sum of the tungsten content and twice the molybdenum content is 30 – 50%, the vanadium content is 4.0 – 10.0% and the cobalt content is 5 – 13%.

6. A high speed tool steel enriched with at least 24% of carbides in the quenched state, which consists essentially of, by weight, 0.62 – 3.95% of carbon, 24 – 50% of a tungsten equivalent that is the sum of the content of tungsten and twice the content of molybdenum, 3.0 – 5.0% of chromium, 1.0 – 10.0% of vanadium, 5 – 15% of cobalt, 0.03 – 0.07% of nitrogen and the balance consisting essentially of iron and impurities and which is produced by a powder metallurgical process that includes preparing an alloy powder and compacting of the powder, said carbides including the MC and $M_6C$ type carbides.

7. A high speed tool steel enriched with at least 24% of carbides in the quenched state, which consists essentially of, by weight 0.62 – 3.95% of carbon, 24 – 50% of a tungsten equivalent that is the sum of the content of tungsten and twice the content of molybdenum, 3.0 – 5.0% of chromium, 1.0 – 10.0% of vanadium, 5 – 15% of cobalt, 0.03 – 0.15% of titanium and the balance consisting essentially of iron and impurities and which is produced by a powder metallurgical process that includes preparing an alloy powder and compacting of the powder, said carbides including the MC and $M_6C$ type carbides.

8. A high speed tool steel enriched with at least 24% of carbides in the quenched state, which consists essentially of, by weight, 0.62 – 3.95% of carbon, 24 – 50% of a tungsten equivalent that is the sum of the content of tungsten and twice the content of molybdenum, 3.0 – 5.3% of chromium, 1.0 – 10.0% of vanadium, 5 – 15% of cobalt, 0.03 – 0.07% of nitrogen, 0.03 – 0.15% of titanium and the balance consisting essentially of iron and impurities and which is produced by a powder metallurgical process that includes preparing an alloy powder and compacting of the powder, said carbides including the MC and $M_6C$ type carbides.

9. A high speed tool steel according to claim 1, wherein the carbon content is about 1.3%, the sum of the tungsten content and twice the molybdenum content is about 24.5%, the chromium content is about 3.6%, the vanadium content is about 3.5% and the cobalt content is about 8.4%.

10. A cutting tool having good toughness and excellent wear resistance and cutting endurance, which comprises the high speed tool steel of claim 1.

11. A high speed tool steel according to claim 1, wherein said steel has a deflective strength of at least 170 Kg/mm² and a hardness of at least 67HRC.

12. A high speed tool steel according to claim 6, wherein said steel has a deflective strength of at least 170 Kg/mm² and a hardness of at least 67HRC.

13. A high speed tool steel according to claim 7, wherein said steel has a deflective strength of at least 170 Kg/mm² and a hardness of at least 67HRC.

14. A high speed tool steel according to claim 1, wherein the molybdenum content ranges from 5 – 10.4% and the tungsten content ranges from 8 – 29.04%.

* * * * *